US005885635A

United States Patent [19]

Spring et al.

[11] Patent Number: 5,885,635

[45] Date of Patent: Mar. 23, 1999

[54] APPARATUS FOR DISPERSING A SUBSTANCE IN A LIQUID BEVERAGE

[75] Inventors: Robert E. Spring, New York, N.Y.; David Loper, Tallahassee, Fla.; Scott Jones, Essex Fells, N.J.

[73] Assignee: Canning Concepts, Inc., Locust Valley, N.Y.

[21] Appl. No.: 604,033

[22] Filed: Feb. 20, 1996

[51] Int. Cl.[6] ..... B65D 81/32

[52] U.S. Cl. ..... 426/120; 206/222; 220/522; 426/115

[58] Field of Search ..... 426/120, 115; 206/217, 222, 219, 221; 220/521, 522

[56] References Cited

U.S. PATENT DOCUMENTS

| | | | |
|---|---|---|---|
| 2,417,592 | 3/1947 | Dwyer . | |
| 2,647,681 | 8/1953 | Paoli | 426/120 |
| 2,687,130 | 8/1954 | Cohen | 206/222 |
| 2,752,036 | 6/1956 | Parkhurst . | |
| 2,931,731 | 4/1960 | Pohjola | 426/117 |
| 3,134,577 | 5/1964 | Bollmeier . | |
| 3,255,924 | 6/1966 | Modderno | 206/222 |
| 3,305,368 | 2/1967 | Bourelle | 426/120 |
| 3,326,363 | 6/1967 | Bennett et al. | 426/120 |
| 3,386,837 | 6/1968 | Arnot | 426/115 |
| 3,415,360 | 12/1968 | Baumann et al. | 206/222 |
| 3,638,918 | 2/1972 | Denholtz | 206/222 |
| 3,743,520 | 7/1973 | Croner | 426/120 |
| 3,779,372 | 12/1973 | Lloret | 215/6 |
| 3,874,557 | 4/1975 | Porter | 426/109 |
| 3,907,106 | 9/1975 | Purrmann et al. | 206/219 |
| 4,057,047 | 11/1977 | Gossett | 206/219 |
| 4,221,291 | 9/1980 | Hunt . | |
| 4,226,330 | 10/1980 | Butler | 206/219 |
| 4,227,611 | 10/1980 | Hollander | 206/219 |
| 4,264,007 | 4/1981 | Hunt . | |
| 4,333,581 | 6/1982 | Flansburg . | |
| 4,524,078 | 6/1985 | Bardsley et al. | 426/120 |
| 4,596,713 | 6/1986 | Burdette | 206/219 |
| 4,634,003 | 1/1987 | Ueda et al. | 206/221 |
| 4,893,730 | 1/1990 | Bolduc | 206/219 |
| 4,995,218 | 2/1991 | Byrne . | |
| 5,255,812 | 10/1993 | Hsu . | |
| 5,290,574 | 3/1994 | Jamieson et al. . | |

FOREIGN PATENT DOCUMENTS

| | | | |
|---|---|---|---|
| WO8904282 | 5/1989 | WIPO | 426/115 |

*Primary Examiner*—Steven Weinstein
*Attorney, Agent, or Firm*—Robert D. Katz; Robert T. Maldonado

[57] ABSTRACT

An apparatus for dispersing a substance in a liquid beverage contained in a container includes a receptacle containing the substance formed in the interior of the container and an opening tab attached to the top of the container for bursting the receptacle to disperse the substance and for opening a pour panel in the top of the container so that the liquid beverage can be drunk from the container. The receptacle is formed of a flat sheet of an elastic material that is joined at opposite edges thereof to form a burstable seam. One end of the receptacle is a beak that causes the seam to burst upon engagement with the opening tab.

7 Claims, 3 Drawing Sheets

APPARATUS FOR DISPERSING A SUBSTANCE IN A LIQUID BEVERAGE

FIELD OF THE INVENTION

The present invention relates generally to beverage containers and, more specifically, to devices that disperse a substance such as a sweetener (such as aspartame), a flavoring agent or alcohol, or medication, into a beverage in a container.

BACKGROUND OF THE INVENTION

Various devices for dispersing a substance into a beverage container have been proposed. Some of these devices include a removable top containing the substance that is to be dispersed. The top snaps onto the top of a beverage container, such as a cup. Some mechanism, such as a lever, or an operation, such as bending up the top, is used to release the substance into the container, then the top is removed in order to drink the beverage. For example, see U.S. Pat. Nos. 3,326,363 (Bennett), 3,779,372 (de Lloret), 4,634,003 (Ueda), and 5,052,553 (DeSanctis). Other devices include a separate chamber formed at the top of the beverage container to hold the substance to be dispersed, but do not include an integral mechanism for rupturing the chamber and for opening the container. See, for example, U.S. Pat. No. 3,305,368 (Bourelle).

Still other closures include a top which may be snapped onto the beverage container. Depressing a portion of the top releases the substance contained in the top into the container, then the lid is removed to pour the beverage. The beverage is not consumed directly from the container. Moreover, this apparatus requires a specially-manufactured top that seems incompatible with existing canning techniques and may not provide prompt, thorough mixing as required to meet the practical requirements of the beverage industry. See, for example, U.S. Pat. No. 4,785,931 (Weir).

SUMMARY OF THE INVENTION

It is therefore an important or principal object of the present invention to provide an apparatus that facilitates the immediate and thorough dispersing of a substance into a liquid beverage contained in a beverage container, such as a soft drink can, and which is compatible with existing canning techniques.

The foregoing objects are achieved, and the disadvantages of other devices overcome, by providing an apparatus for dispersing a substance in a liquid beverage that includes a container with a non-resealable pour panel opening and an opening tab attached to a top thereof. A burstable receptacle is formed of a flat sheet joined at opposite edges thereof at a seam and attached to an interior of the container. The receptacle has a beak or leading edge at an end of the seam which is mounted to overlap a portion of the pour panel on the underside of the top. When the tab is lifted, the pour panel is forced downward and engages the beak to burst the receptacle open along the seam and disperse the substance. The receptacle is formed of aluminum or plastic material or another suitable material which stores energy with a burst seam of suitable thermoplastic material.

BRIEF DESCRIPTION OF THE DRAWINGS

Further objects, features and advantages of the invention will become apparent upon review of the following detailed description of the preferred embodiments, taken in conjunction with the following drawings, in which.

DETAILED DESCRIPTION OF PREFERRED EMBODIMENTS

The different embodiments of the present invention relate to the configuration and operation of a receptacle that contains a substance to be dispersed in a liquid beverage. The substance can be medication, including analgesics, a flavoring agent, a sweetening agent such as aspartame, or an alcoholic beverage, for example.

Figure 1:
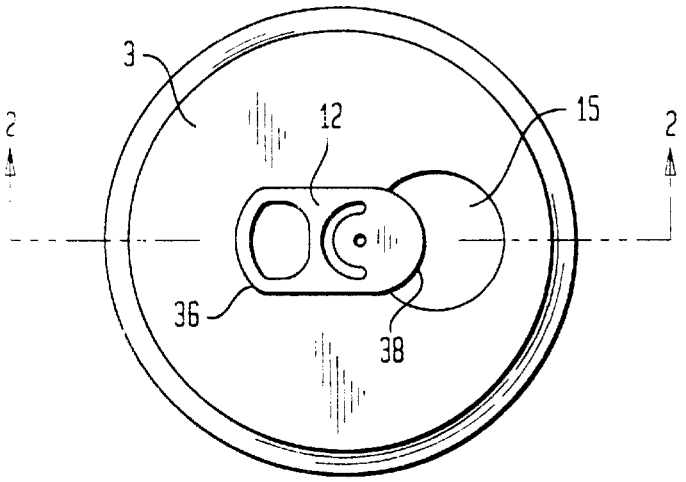
FIG. 1 is a top view of a beverage container incorporating the present invention.
Figure 2:
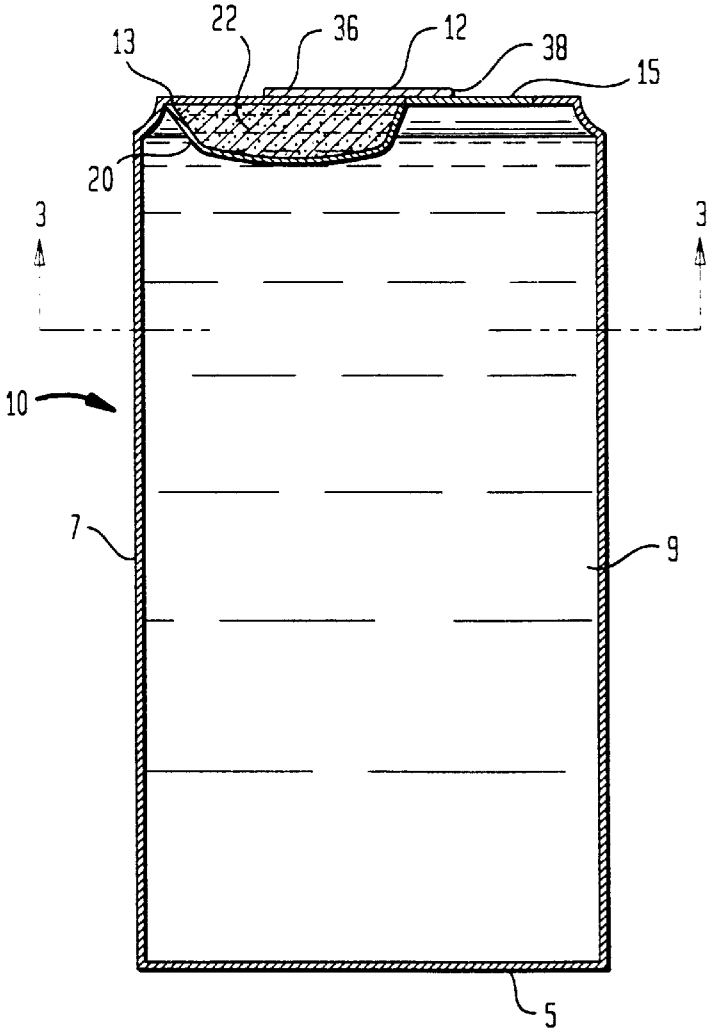
FIG. 2 is a sectional view, taken in section along line 2—2 in FIG. 1, of a beverage container including an ingredient dispenser according to a first embodiment of the present invention.

Referring to the drawings, FIGS. 1–3 and 3A present various views of the first embodiment of an ingredient dispenser in accordance with the present invention for use in conjunction or combination with a conventional beverage container such as a soft drink can. As shown in FIGS. 1 and 2, the beverage container 10 has a top 13, a bottom 5 and a sidewall 7. The bottom 5 may be formed as an integral part of the body or sidewall 7. The container 10 is cylindrical in shape and contains a beverage 9 to be consumed by a user, and can be, for example, (1) a two-piece Drawn and Ironed soft drink can fabricated from aluminum or steel or another material, or (2) a three-piece soft drink can fabricated from steel or another material, both with a retainer tab easy-open top end. The beverage 9 could be any carbonated or non-carbonated soft drink, fruit juice, mixer, sport drink, water or other appropriate or applicable liquid for example. The top 13 of the container 10 has a pour panel 15 that is openable and non-resealable. The pour panel 15 is opened with a tab 12 attached to the upper side of the top 13 of the container 10.

According to a first embodiment of the present invention shown in FIGS. 1–3 and 3A, the container 10 has an ingredient dispenser or receptacle 20 attached to an underside of the top 13 of the container 10. The receptacle 20 is preferably located opposite to the pour panel 15 prior to assembling the container 10 and contains a liquid or solid substance 22 to be dispersed.

Figure 3:
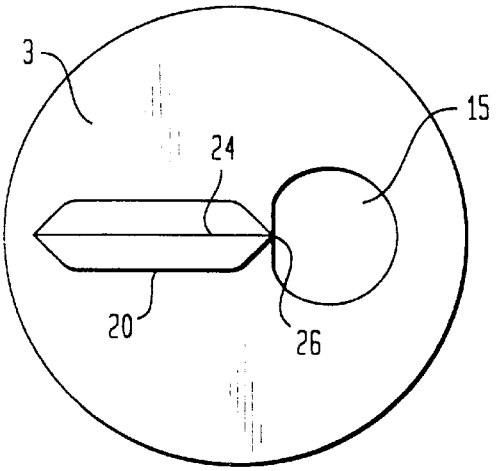
FIG. 3 is a plan view of an underside of the dispenser mounted on the container taken in section along line 3—3 in FIG. 2.

The receptacle 20 has a "pea pod" shape, as shown in FIG. 3 (although potentially of greater or lesser width), including a burstable seam 24 longitudinally formed along a central portion thereof, and a beak 26 formed at least at one end of the receptacle 20.

The receptacle 20 is formed of a single flat sheet of an elastic material such as aluminum or plastic or another suitable material joined at opposite edges thereof by a burstable material such as specialized non-toxic epoxy or another thermoplastic material to form the seam 24. The elastic energy stored in the material forming the receptacle 20 is equal to the work done in deforming the flat, unstressed, planar sheet into a generally cylindrical shape. The work Q is derived from the following formula:

$$Q = \frac{\pi^2 ELh^3}{6W(1-\mu^2)}$$

where E is the modulus of elasticity ($10^7$ $lb_f/in^2$ for aluminum), L is the length of the cylinder, h is the thickness of the sheet, W is the width of the sheet, and $\mu$ is Poisson's ratio (1/8 for aluminum). In order for the energy to be stored, however, the sheet must not be deformed past its elastic limit. For an elastic limit $\epsilon$, the allowable range of deformation can be computed according to the following formula:

$$\pi h \leq \epsilon W.$$

Thus, knowing the thickness of the sheet, h, and the elastic limit of the material, $\epsilon$, the minimum allowable width W of the receptacle 20 can be determined. The stored energy Q represents the force that is used to disperse the substance 22 contained in the receptacle 20 when it is ruptured.

The top 13 can be manufactured by using a conventional soft drink retainer tab can top 13, for example, and adhering the receptacle 20 underneath, as shown in FIG. 3. Care must be taken to use a non-toxic food grade adhesive having a burst strength higher than the one used to anneal the seam.

Figure 3A:
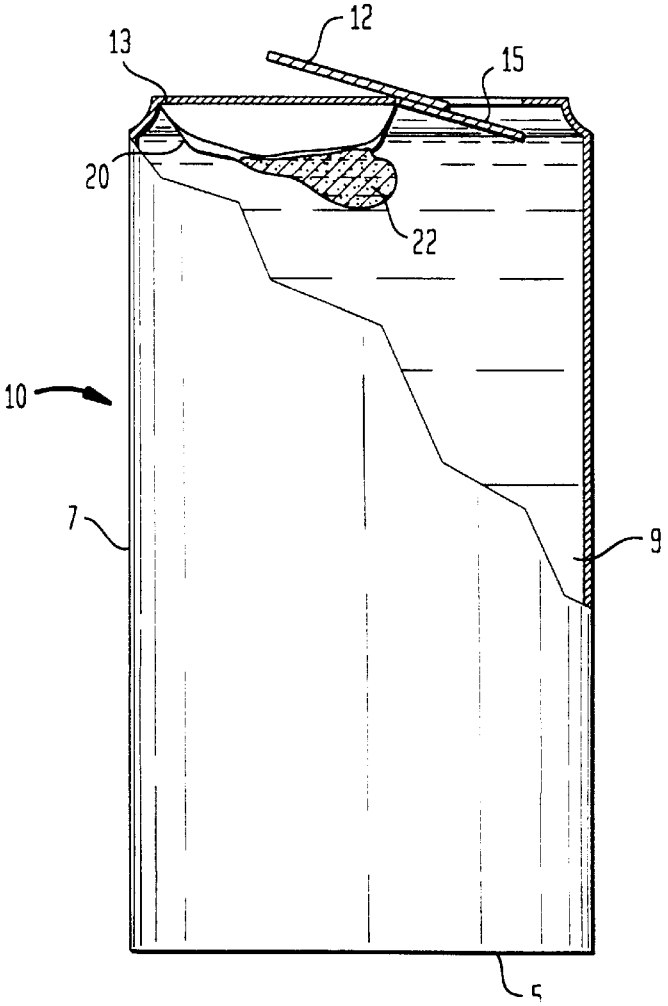
FIG. 3A is a partial sectional view of the beverage container showing the ingredient dispenser after bursting.

To release the substance 22 into the beverage 9 contained in the container 10, a user lifts an end 36 of the opening tab 12. An opposite end 38 of the tab 12 moves angularly downward and engages pour panel 15 which engages the beak 26 of the receptacle 20. Upon such engagement, the seam 24 is ruptured and the receptacle 20 opens, thereby releasing the stored energy and dispersing the substance 22 contained in the receptacle 20 into the beverage 9 contained in the container 10, as shown in FIG. 3A.

Figure 4:
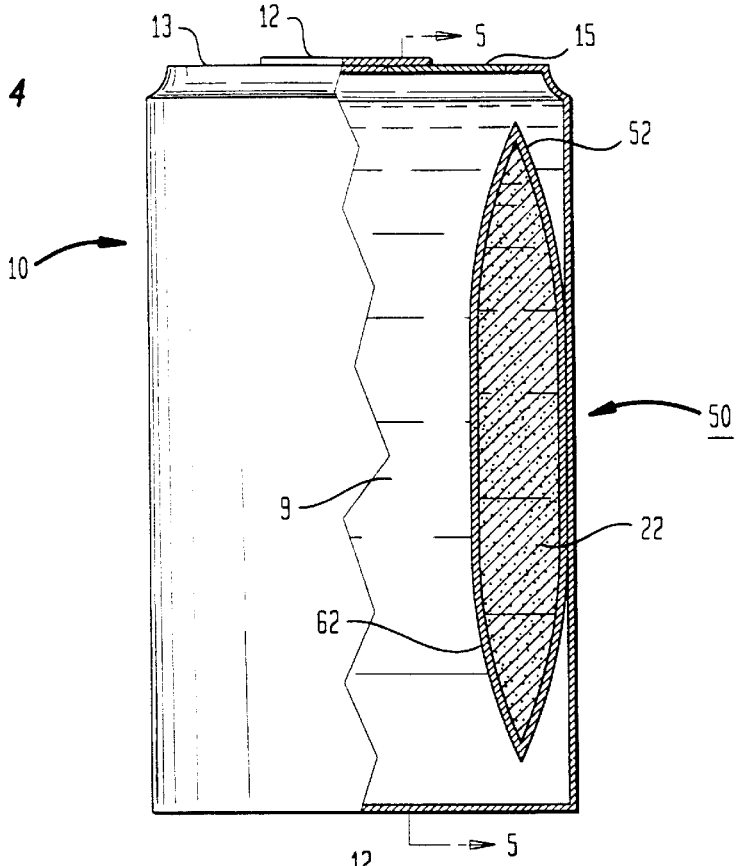
FIG. 4 is a side view partially in section and partially broken away of a beverage container including an ingredient dispenser according to a second embodiment of the present invention.
Figure 5:
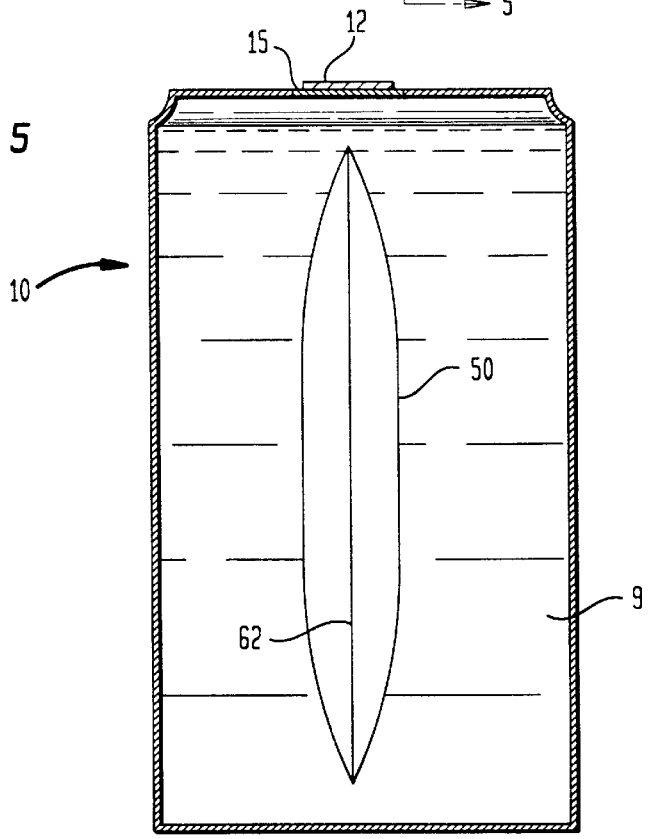
FIG. 5 is a sectional view, taken in section along line 5—5 in FIG. 4.

According to another embodiment of the invention shown in FIGS. 4 and 5, the receptacle 50, which is generally cylindrical in shape and formed of a single, flat sheet of an elastic material such as aluminum or plastic joined at opposite edges thereof to form a seam 62 and to define a space for containing a substance 22 to be dispersed in a beverage 9, is attached to a sidewall of the container 10 with an adhesive such as epoxy. At least one end of the receptacle 50 has a beak 52. The receptacle 50 has the same mechanical properties as the receptacle 20 of the first embodiment. According to this second embodiment, when the opener 12 is lifted, the pour panel 15 breaks open and moves angularly downward. At a certain point, the pour panel 15 engages the beak 52 of the receptacle 50 and exerts a force on it, thereby rupturing the seam 62. Once the receptacle 50 bursts open, the elastic energy stored in the sheet forming the receptacle 50 is released, thereby causing the substance 22 to disperse in the beverage 9 contained in the container 10. The combined mixture of the beverage 9 and the substance 22 can then be consumed through the opening of the container 10.

Although the various embodiments of the subject invention have been disclosed and illustrated with reference to application of the dispersing apparatus to a beverage can, it should be apparent to a person of ordinary skill in the art that the dispersing apparatuses herein disclosed can be applied to other types of containers, such as bottles, without departing from the scope of the present invention. Having described specific preferred embodiments of the present invention with reference to the accompanying drawings, it is to be understood that the invention is not limited to those precise embodiments, and that various changes and modifications may be effected therein by one skilled in the art without departing from the spirit or the scope of the present invention as defined in the appended claims.

What is claimed is:

1. An apparatus for dispersing a substance in a liquid beverage comprising:

a container containing a liquid beverage, the container including a bottom and at least one side defining an interior;

a top having a non-resealable pour panel attached thereto;

a burstable receptacle included in the interior of the container and containing a substance to be dispersed in the beverage, the receptacle being formed of a flat sheet of an elastic material that has been deformed so that the opposite edges of the flat sheet are releasable joined to form a seam and a beak at least at one end of the seam, the deformation having created elastic energy in the sheet which is stored in the sheet while the opposite edges remain joined; and an opening tab attached to the top such that lifting the opening tab breaks open the pour panel said burstable receptacle being positioned in the container such that when said opening tab breaks open the pour panel, the pour panel engages the beak of the burstable receptacle in the container causing a break in the seam which propagates along a length of the seam, thereby releasing the elastic energy stored in the sheet so that the receptacle bursts open and the substance is dispersed in the liquid beverage.

2. An apparatus according to claim 1, wherein the receptacle is generally cylindrical.

3. An apparatus according to claim 1, wherein the receptacle is attached to the top of the container with the beak adjacent the pour panel.

4. An apparatus according to claim 1, wherein the receptacle is attached to the side of the container in the interior thereof.

5. An apparatus according to claim 1, wherein the receptacle is formed of thermoplastic material.

6. An apparatus according to claim 1, wherein the receptacle is formed of a sheet of aluminum.

7. An apparatus according to claim 6, wherein the receptacle is coated with and the seam is comprised of a thermoplastic material.

* * * * *